United States Patent [19]

Yamaguchi et al.

[11] Patent Number: 4,749,450

[45] Date of Patent: Jun. 7, 1988

[54] APPARATUS FOR PLATING METAL STRIP IN ELECTROLYTIC CELL

[75] Inventors: Yasuhiro Yamaguchi; Yuji Shimoyama; Tadakuni Mori; Toshimichi Ukena; Hisao Yasunaga, all of Chiba, Japan

[73] Assignee: Kawasaki Steel Corporation, Hyogo, Japan

[21] Appl. No.: 935,454

[22] Filed: Nov. 26, 1986

[30] Foreign Application Priority Data

Nov. 28, 1985 [JP] Japan ..... 60-268116

[51] Int. Cl.[4] ..... C25D 7/06

[52] U.S. Cl. ..... 204/28; 204/206

[58] Field of Search ..... 204/28, 206

[56] References Cited

U.S. PATENT DOCUMENTS

| | | | |
|---|---|---|---|
| 1,917,657 | 7/1933 | MacChesney | 204/28 |
| 2,936,278 | 5/1960 | Shoemaker et al. | 204/206 |
| 4,248,674 | 2/1981 | Leyh | 204/28 |
| 4,367,125 | 1/1983 | Avellone | 204/28 |

FOREIGN PATENT DOCUMENTS

| | | | |
|---|---|---|---|
| 448243 | 1/1913 | France | 204/28 |
| 889657 | 10/1943 | France | 204/28 |

*Primary Examiner*—T. M. Tufariello

*Attorney, Agent, or Firm*—Austin R. Miller

[57] ABSTRACT

An apparatus for plating a metal strip in an electrolytic cell is provided with a supporting roll. The support roll is disposed apart from the deflector rolls by a predetermined distance and supports the metal strip in such a way that the catenary of the metal strip can be reduced. The distance is determined so that the catenary is 0.04 or less times of the distance between upper and lower electrodes in the electrolytic cell. When the metal strip is a steel plate having a density of $7.85\times10^{-6}$ (kg/mm$^3$), the predetermined distance l (mm) between the axis of the deflector roll and that of the supporting roll is subject to the following formula:

$$l \leqq \sqrt{\frac{40.8 \times 10^3 \times T \times \Delta D}{W \times t}}$$

in which the distance between the upper and lower electrodes is ΔD (mm), the thickness of the metal strip being t (mm), the width thereof being W (mm) and the tension applied to the metal strip being T (kg).

12 Claims, 2 Drawing Sheets

APPARATUS FOR PLATING METAL STRIP IN ELECTROLYTIC CELL

BACKGROUND OF THE INVENTION

1. Field of the Invention

The present invention relates generally to an apparatus for plating a metal strip in an electrolytic cell. More specifically the invention relates to an apparatus for plating a metal strip, which apparatus can generate an deposit of consistent thickness on the surface of the metal strip.

2. Description of the Prior Art

In a horizontal pass-line type of apparatus for simultaneously plating the upper and lower surface of a metal strip, deflector rolls have been generally used near the opposing inside walls in a plating bath in order to deflect the flow direction of the metal strip fed from a point outside of the plating bath. However, when the distance between the deflectors is relatively large, the metal strip will be warped across its width and may have a large catenary longitudinally, so that the distance between the metal strip and electrodes of the apparatus is not constant. In this condition, when the metal strip is plated in the plating bath, a deposit of uneven thickness tends to occur on the surfaces of the metal strip. Therefore, a conventional apparatus is provided with deflector rolls as well as snubber rolls or presser rolls, which clamp the metal strip, so as to decrease the warp in the lateral and longitudinal catenary of the metal strip.

However, since the deflector rolls and snubber rolls in the aforementioned apparatus rotate so that one presses against another under a predetermined pressure in the electrolytic solution, there is a problem in that the rolls do not tend to clamp only the metal strip but also foreign matter, such as sludge and slimes, in the plating bath, thereby marring the metal strip.

SUMMARY OF THE INVENTION

It is therefore a principle object of the present invention to eliminate the aforementioned problems in conventional apparatus for plating a metal strip in an electrolytic cell and provide an apparatus which can generate a deposit of even thickness on the surface of the metal strip.

In order to accomplish the aforementioned and other specific objects, an apparatus for plating a metal strip, according to the present invention, is provided with at least one support roll between the deflector rolls. This support roll is disposed at a predetermined distance from the deflector rolls and/or the other support rolls so that the distance between the metal strip and electrodes of the apparatus is substantially constant.

According to one aspect of the present invention, an apparatus for plating a metal strip in an electrolytic cell comprises: a processing bath filled out with electrolytic solution, first means for deflecting said metal strip, a pair of electrodes for electroplating the metal strip, second means for suspending the electrodes and for conducting electricity for the electrodes, and third means for supporting the metal strip so as to be disposed at a predetermined distance from the first means, thereby reducing the longitudinal catenary of the metal strip. The first means may be a deflector roll having an axis extending horizontally, the second means may be a pair of bus bars and the third means may be at least one supporting roll having an axis extending horizontally.

The electrodes may also be upper and lower electrodes essentially parallel to each other, between which the metal strip passes. The distance is preferably determined so that the catenary is 0.04 or less times of the distance between the upper and lower electrodes. In addition, when the metal strip is a steel plate having a density of $7.85\times10^{-6}$ (kg/mm$^3$), the distance l (mm) between the support roll and the deflector roll and/or between the support rolls is preferably subject to the following formula:

$$l \leqq \sqrt{\frac{40.8\times10^3\cdot T\cdot\Delta D}{W\cdot t}} \qquad (6)$$

in which the distance between the upper and lower electrodes is ΔD (mm), the thickness of the metal strip being t (mm), the width thereof being W (mm) and the tension applied to the metal strip being T (kg).

According to another aspect of the invention, the process for plating a metal strip in an electrolytic cell comprises the steps of: introducing the metal strip into a processing bath filled out with electrolytic solution, deflecting the metal strip by means of first deflecting means so that the metal strip is essentially horizontal, electroplating the metal strip by means of a pair of upper and lower electrodes parallel to each other, supporting the metal strip so as not to have relatively large catenary by means of supporting means apart from the first deflecting means by a predetermined distance, deflecting the metal strip by means of second deflecting means separated from the supporting means by a predetermined distance, and taking the metal strip out of the processing bath.

BRIEF DESCRIPTION OF THE DRAWINGS

The present invention will be understood more fully from the detailed description given herebelow and from the accompanying drawings of the preferred embodiment of the invention. The drawings are not intended to imply limitation of the invention to this specific embodiment, but are for explanation and understanding only.

In the drawings.

DESCRIPTION OF THE PREFERRED EMBODIMENT

Figure 1:
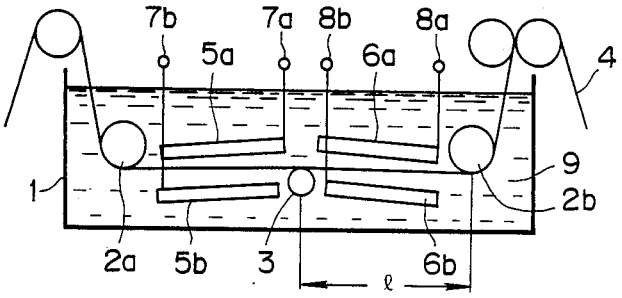
FIG. 1 is a schematic diagram of a preferred embodiment of an apparatus for plating a metal strip in an electrolytic cell according to the present invention.

Referring now to the drawings, particularly to FIG. 1, the preferred embodiment of an apparatus for plating a metal strip, according to the present invention, can plate a metal strip 4 in a processing bath 1, such as a plating bath. The processing bath 1 is filled out with electrolytic solution 9. The processing bath 1 is provided with deflector rolls *2a* and *2b* near its opposing inside walls. The metal strip 4 is deflected by means of the deflector rolls *2a* and *2b* so as to be essentially horizontal between the deflector rolls *2a* and *2b* in the processing bath 1. Two pair of electrodes *5a, 5b* and *6a, 6b* are provided between the deflector rolls *2a* and *2b* in series. The electrode *5a* is essentially parallel to the electrode 5b and the electrode 6a is essentially parallel to the electrode 6b, so that the metal strip 4 can be disposed between the electrodes 5a and 5b and between the electrodes 6a and 6b. The electrodes 5a, 5b, 6a and 6b are connected to bus bars 7a, 7b, 8a and 8b, through which electric currents flow for the electrodes 5a, 5b, 6a and 6b, and suspended by the bus bars 7a, 7b, 8a and 8b. According to the preferred embodiment of the present invention, a support roll 3 is provided between two pair of electrodes 5a, 5b and 6a, 6b, said support roll 3 disposed at a predetermined distance from the deflector rolls and supports the metal strip 4. The metal strip 4 is supported by the support roll 3 so as to be essentially horizontal, thus the longitudinal catenary and warpage in the lateral axis of the metal strip 4 can be reduced.

It is described below how to determine the optimum distance between the axis of the deflector roll 2a or 2b and that of the support roll 3 in the processing bath 1.

When the metal strip 4 runs in the processing bath 1 by means of the deflector rolls 2 so that the the metal strip 4 has a predetermined tension T (kg), the catenary $\Delta h_1$ (mm) of the metal strip 4 between the deflector roll 2a or 2b and the support roll 3 can be expressed as follows:

$$\Delta h_1 = \frac{wl^2}{8T} \tag{1}$$

wherein w denotes the unit weight (kg/mm) of the metal strip 4, and l is the length of a pass, that is, the distance (mm) between the deflector roll 2a or 2b and the support roll 3, which supports the metal strip 4 passing through the space between the electrodes 5a and 5b and between the electrodes 6a and 6b.

Furthermore, the relationship between the catenary $\Delta h_1$ and the thickness distribution of the deposit on the surface of the metal strip 4 was tested by using a pilot arrangement. As a result, a deposit of essentially uniform thickness across the lateral axis of deposit on the surface of the metal strip 4 was obtained when the relationship between the catenary $\Delta h_1$ and the distance $\Delta D$ between the electrodes was expressed by the following formula:

$$(\Delta h_1/\Delta D) \leqq 0.04 \tag{2}$$

Therefore, if at least one support roll is provided between the deflector rolls so as to be disposed at a predetermined distance from the deflector rolls 2a and 2b and/or the other support rolls, a deposit of essentially uniform thickness across the lateral axis of diposit on the surface of the metal strip 4 may be obtained. The distance is preferably determined so that the catenary $\Delta h_1$ is equal to or less than $0.04 \times \Delta D$. The length of a pass l can be obtained from this result and the expression (1).

If the width of the metal strip 4 is labelled with W (mm), its thickness labelled with t (mm) and its density labelled with $\gamma$ (kg/mm$^3$), the unit weight w can be expressed by the following formula:

$$w = \gamma \times W \times t \tag{3}$$

In addition, the following formula can be obtained from the formulae (1) and (3).

$$\Delta h_1 = \frac{\gamma \times W \times t \times l^2}{8T} \tag{4}$$

Therefore, from the formulae (2) and (4), the following formula can be obtained.

$$\frac{\gamma \times W \times t \times l^2}{8T \cdot \Delta D} \leqq 0.04 \tag{5}$$

If the metal strip 4 is a steel plate, $\gamma = 7.85 \times 10^{-6}$ (kg/mm$^3$). Therefore, the pass length l (mm) can be obtained from the formula (5) as follows:

$$l \leqq \sqrt{\frac{40.8 \times 10^3 \times T \times \Delta D}{W \times t}} \tag{6}$$

If the pass length l is determined as the formula (6), a deposit of uniform thickness can be generated on the surface of the metal strip 4.

Figure 3:
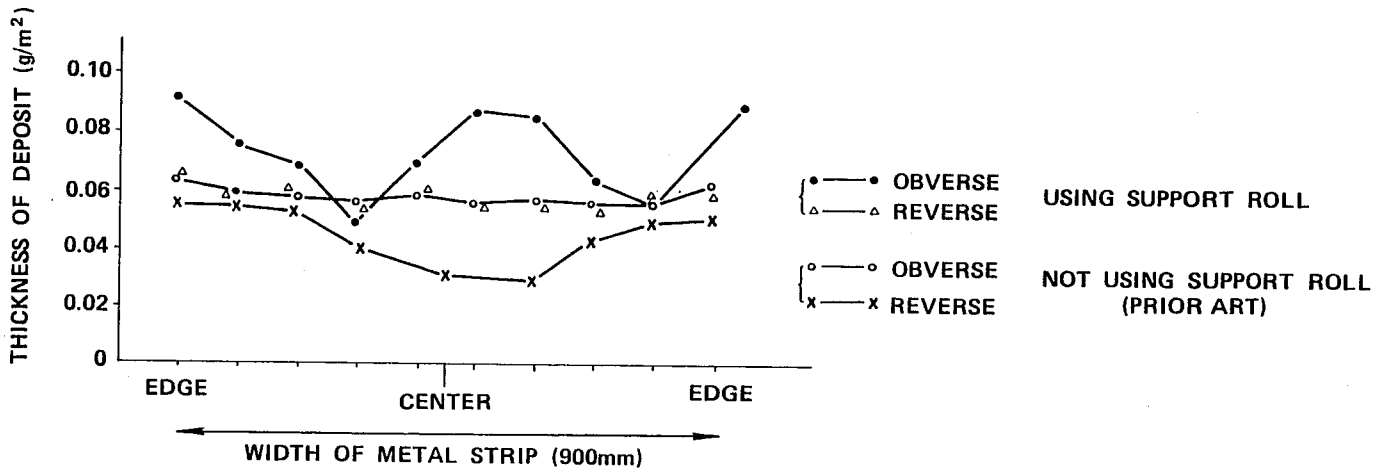
FIG. 3 is a graph showing the thickness of the deposit relative to the position of the metal strip according to an apparatus of the present invention and prior art.

A metal strip was plated by electrolytic Ni-plating by using an apparatus for plating according to the present invention shown in FIG. 1. As shown in FIG. 3, the thickness of the deposit was essentially equal near the center and edges on the surface of the metal strip 4. The unit weight of the deposit was 0.06 g/m$^2$ near the center and edges on the surface of the metal strip and its scattering was lower than $\pm 5\%$. Furthermore, the thickness of the deposit on the surface of the metal strip is similar to the aforementioned results with respect to longitudinal direction.

Figure 2:
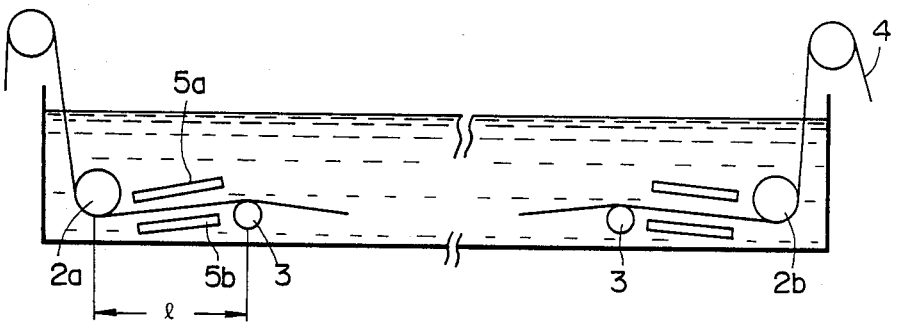
FIG. 2 is a schematic diagram of another preferred embodiment using a long plating bath.

According to another preferred embodiment of the present invention, a plurality of support rolls 3 can also be used in the apparatus for plating a metal strip as shown in FIG. 2. In this case, the distance between the axes of the support rolls is preferably similar to l shown in formula (6).

What is claimed is:

1. An apparatus for plating a metal strip in an electrolytic cell comprising:

a processing bath containing an electrolytic solution;

first means for deflecting said metal strip;

upper and lower electrodes essentially parallel to each other, between which said metal strip passes to be electroplated;

second means for suspending said electrodes and for conducting electricity for said electrodes; and third means for supporting said metal strip and disposed at a predetermined distance from the first means, the distance l (mm) between said first means and said third means being subject to the following formula:

$$l \leqq \sqrt{\frac{0.32 \times T \times \Delta D}{W \times t \times \gamma}}$$

in which the distance between the upper and lower electrodes is $\Delta D$ (mm), the thickness of the metal strip being t (mm), the width thereof being W (mm), the density thereof being $\gamma$ (kg/mm$^3$) and the tension applied to the metal strip being T (kg), thereby reducing the longitudinal catenary of said metal strip.

2. An apparatus for plating a metal strip as set forth in claim 1, wherein said first means is a deflector roll having an axis extending horizontally.

3. An apparatus for plating a metal strip as set forth in claim 2, wherein said second means are a pair of bus bars.

4. An apparatus for plating a metal strip as set forth in claim 2, wherein said third means is at least one supporting roll having an axis extending horizontally.

5. An apparatus for plating a metal strip in an electrolytic cell comprising:

a processing bath containing an electrolytic solution;

a pair of deflector rolls, each of which has an axis extending in an essentially horizontal direction, for deflecting said metal strip;

upper and lower electrodes essentially parallel to each other, between which said metal strip passes to be electroplated;

means for suspending said electrodes and for conducting electricity for said electrodes; and at least one supporting roll which has an axis extending in an essentially horizontal direction for supporting said metal strip, the distance l (mm) between the axis of said supporting roll and that of said deflector roll and/or between the axes of said supporting rolls being determined so that the catenary is 0.04 or less times the distance between the upper and lower electrodes.

6. An apparatus for plating a metal strip in an electrolytic cell comprising:

a processing bath containing an electrolytic solution;

first means for deflecting said metal strip;

a pair of electrodes for electroplating said metal strip;

second means for suspending said electrodes and for conducting electricity for said electrodes; and third means for supporting said metal strip so as to be disposed at a predetermined distance from the first means, thereby reducing the longitudinal catenary of said metal strip wherein said third means is at least one supporting roll having an axis extending horizontally wherein, when the metal strip is a steel plate having a density of $7.85\times10^{-6}$ (kg/mm$^3$), the distance l (mm) between the axis of said deflector roll and that of said supporting roll and/or between the axis of said supporting rolls is subject to the following formula $$l \leqq \sqrt{\frac{40.8 \times 10^3 \times T \times \Delta D}{W \times t}}$$

in which the distance between the upper and lower electrodes is ΔD (mm), the thickness of the metal strip being t (mm), the width thereof being W (mm) and the tension applied to the metal strip being T (kg).

7. A process for plating a metal strip in a electrolytic cell comprising the steps of:

introducing the metal strip into a processing bath containing an electrolytic solution;

deflecting the metal strip by means of first deflecting means so that the metal strip is essentially horizontal;

electroplating the metal strip by means of a pair of upper and lower electrodes parallel to each other;

supporting the metal strip so as not to have a relatively large catenary by means of supporting means apart from said first deflecting means by a predetermined distance;

deflecting the metal strip by means of second deflecting means separated from said supporting means by a predetermined distance, said predetermined distances l (mm) between the axis of said supporting means and that of said first and second deflecting means and/or between the axes of said supporting means being subject to the following formula:

$$l \leqq \sqrt{\frac{40.8 \times 10^3 \times T \times \Delta D}{W \times t}}$$

in which the distance between the upper and lower electrodes is ΔD (mm), the thickness of the metal strip being t (mm), the width thereof being W (mm), the tension applied to the metal strip being T (kg) and the metal strip being a steel plate having a density of $7.85\times10^{-6}$ (kg/mm$^3$), thereby reducing the longitudinal catenary of said metal strip; and taking the metal strip out of said processing bath.

8. A process for plating a metal strip in an electrolytic cell comprising the steps of:

introducing the metal strip into a processing bath containing an electrolytic solution;

deflecting the metal strip by means of first deflecting means so that the metal strip is essentially horizontal;

electroplating the metal strip by means of a pair of upper and lower electrodes parallel to each other;

supporting the metal strip so as not to have a relatively large catenary by means of supporting means apart from said first deflecting means by a predetermined distance;

deflecting the metal strip by means of second deflecting means separated from said supporting means by a predetermined distance, the predetermined distances being determined so that the catenary is 0.04 or less times of the distance between the upper and lower electrodes; and taking the metal strip out of said processing bath.

9. An apparatus for plating a metal strip in an electrolytic cell comprising:

a processing bath containing an electrolytic solution;

a pair of deflector rolls, each of which has an axis extending in an essentially horizontal direction, for deflecting said metal strip;

upper and lower electrodes essentially parallel to each other, between which said metal strip passes to be electroplated;

means for suspending said electrodes and for conducting electricity for said electrodes; and at least one supporting roll having an axis extending in an essentially horizontal direction, for supporting said metal strip, the distance l (mm) between the axis of said supporting roll and that of said deflector roll and/or between the axes of said supporting rolls being subject to the following formula:

$$l \leqq \sqrt{\frac{40.8 \times 10^3 \times T \times \Delta D}{W \times t}}$$

in which the distance between the upper and lower electrodes is ΔD (mm), the thickness of the metal strip being t (mm), the width thereof being W (mm), the tension applied to the metal strip being T (kg) and the metal strip being a steel plate having a density of $7.85\times10^{-6}$ (kg/mm$^3$), thereby reducing the longitudinal catenary of said metal strip.

10. An apparatus for plating a metal strip as set forth in claim 9, wherein said means are a pair of bus bars.

11. An apparatus for plating a metal strip in an electrolytic cell comprising:

a processing bath containing an electrolytic solution;

a pair of deflector rolls for deflecting said metal strip;

upper and lower electrodes essentially parallel to each other, between which said metal strip passes to be electroplated;

means for suspending said electrodes and for conducting electricity for said electrodes; and at least one supporting roll for supporting said metal strip, the distance l (mm) between the axis of said supporting roll and that of said deflector roll and/or between the axes of said supporting rolls being essentially subject to the following formula:

$$l=\sqrt{\frac{40.8\times10^3\times T\times\Delta D}{W\times t}}$$

in which the distance between the upper and lower electrodes is ΔD (mm), the thickness of the metal strip being t (mm), the width thereof being W (mm), the tension applied to the metal strip being T (kg) and the metal strip being a steel plate having a density of $7.85\times10^{-6}$ (kg/mm$^3$), thereby reducing the longitudinal catenary of said metal strip.

12. An apparatus for plating a metal strip in an electrolytic cell comprising:

a processing bath containing an electrolytic solution;

a pair of deflector rolls for deflecting said metal strip;

upper and lower electrodes essentially parallel to each other, between which said metal strip passes to be electroplated;

means for suspending said electrodes and for conducting electricity for said electrodes; and at least one supporting roll for supporting said metal strip, the distance l (mm) between the axis of said supporting roll and that of said deflector roll and/or between the axes of said supporting rolls being determined so that the catenary is essentially 0.04 of the distance between the upper and lower electrodes.

* * * * *